US007527701B2

(12) United States Patent
Cornil et al.

(10) Patent No.: US 7,527,701 B2
(45) Date of Patent: May 5, 2009

(54) METHOD AND PLANT FOR COOLING A MOVING METAL STRIP

(75) Inventors: Hugues Cornil, Liege (BE); Yann Greday, Liege (BE); Benoît Deweer, Ivoz-Ramet (BE); Stéphane Lecomte, Jemeppe (BE); Jacques Mottoulle, Ivoz-Ramet (BE)

(73) Assignee: Usinor, Puteaux (FR)

( * ) Notice: Subject to any disclaimer, the term of this patent is extended or adjusted under 35 U.S.C. 154(b) by 432 days.

(21) Appl. No.: 10/560,175

(22) PCT Filed: Jun. 9, 2004

(86) PCT No.: PCT/FR2004/001441

§ 371 (c)(1),
(2), (4) Date: May 22, 2006

(87) PCT Pub. No.: WO2004/111280

PCT Pub. Date: Dec. 23, 2004

(65) Prior Publication Data

US 2006/0254682 A1 Nov. 16, 2006

(30) Foreign Application Priority Data

Jun. 11, 2003 (EP) ..... 03291389

(51) Int. Cl.
*C21D 1/62* (2006.01)

(52) U.S. Cl. ..... 148/658; 266/109; 266/260

(58) Field of Classification Search ..... 148/657, 148/658; 266/109, 115, 260
See application file for complete search history.

(56) References Cited

U.S. PATENT DOCUMENTS 5,182,074 A * 1/1993 Yoshioka et al. ..... 266/103
6,056,913 A 5/2000 Ebner et al.

FOREIGN PATENT DOCUMENTS

| | | | |
|---|---|---|---|
| EP | 0 418 166 | A1 | 3/1991 |
| JP | 57-43939 | A | 3/1982 |
| JP | 60-255933 | A | 12/1985 |
| JP | 2-11729 | A | 1/1990 |
| JP | 4-107221 | A | 4/1992 |
| JP | 2001-323325 | A | 11/2001 |

* cited by examiner

*Primary Examiner*—Scott Kastler
(74) *Attorney, Agent, or Firm*—Sughrue Mion, PLLC

(57) ABSTRACT

In order to cool a metal strip (2) which moves in a continuous manner:

the strip (2) is pressed onto a main cooling roller (10) so that the strip forms an arc whose inner face delimits, with the outer face of this roller, a contact zone which is suitable for discharging part of the heat of the strip towards the inner side of the roller, the strip (2) is held in contact with the main cooling roller (10) by means of a support roller (14) on the outer face of the strip, which roller is constituted by a resiliently deformable and thermo-capacitive material, and the heat transmitted from the strip (2) to the support roller (14) is discharged using secondary cooling means (16).

10 Claims, 3 Drawing Sheets

METHOD AND PLANT FOR COOLING A MOVING METAL STRIP

The present invention relates to a method and an assembly for cooling a moving metal strip.

It is used in particular for vacuum treatments of a strip of this type, in particular for hot coatings.

In order to correctly carry out thermal processing operations, such as annealing operations or continuous coatings, on a steel strip, it is generally necessary to successively heat and cool the strip at predetermined rates. In order to cool a strip of this type in a controlled manner, the strip is quenched, by a jet of gas, by a jet of liquid or by at least one cooling roller with which the strip comes into contact.

Known methods of cooling by means of a roller consist in pressing a strip, which moves in accordance with a continuous movement, onto at least one cooling roller, at the inner side of which a cooling liquid flows, in particular cold water. The roller can be moved in terms of rotation about the axis thereof, being driven either by the friction of the moving strip or by means of a separate motorised assembly. The strip which is pressed in this manner onto the roller forms an arc whose inner face delimits, with the outer face of the roller, a contact zone which is suitable for discharging part of the heat of the strip towards the inner side of the roller.

In order to improve the contact between the strip and the cooling roller, it has previously been proposed that the arc of the strip be held in contact with the roller by means of metal support rollers on the outer face of the arc. In order to ensure that the effect of pressing the strip flat onto the cooling roller is maintained, each of these support rollers is mounted so as to freely rotate about the axis thereof, at the end of rigid arms whose spacing relative to the cooling roller is predetermined in accordance with the thickness of the strip.

Although metal support rollers of this type produce the intended retention of the strip on the cooling roller, they involve the risk, on the one hand, of marking the outer face of the strip, this marking being able to be very deep if there is a fault in terms of the parallelism of the axes of the cooling roller and the support rollers and, on the other hand, of impairing the cooling of the strip owing to the rapid accumulation of heat in the support rollers.

The object of the present invention is to provide a method and an assembly for cooling a moving metal strip, which allow the strip to be held securely against a cooling roller whilst controlling this cooling operation and without thereby impairing the surface condition of the strip.

To this end, the invention relates to a method for cooling a moving metal strip, of the type in which:

the metal strip to be cooled is moved in a continuous manner, the strip is pressed onto a main cooling roller which can be moved about the axis thereof so that the strip forms an arc whose inner face delimits, with the outer face of the main cooling roller, a contact zone which is suitable for discharging part of the heat of the strip towards the inner side of this roller, and the strip is held in contact with the main cooling roller by means of at least one support roller on the outer face of the arc formed by the strip, the or each support roller being arranged substantially parallel with the main cooling roller and so as to be movable in terms of rotation about the axis thereof, characterised in that the or each support roller is constituted, at least at the periphery, by a resiliently deformable and thermo-capacitive material, and in that the heat transmitted from the strip to the or each support roller is discharged by secondary cooling means which are suitable for forming, with a portion of the outer face of the or each support roller, a zone for transferring heat towards these secondary cooling means.

According to other features of this method, taken in isolation or according to all technically possible combinations:

the or each support roller extends at least over the entire width of the strip so as to apply to the outer face of the arc formed by the strip a pressure which is substantially homogeneous over this entire width;

the temperature of the strip pressed at the inlet of the main cooling roller is lower than the degradation temperature of the material which constitutes the support roller(s); and the temperature of the strip pressed at the inlet is lower than approximately 200° C.

The invention also relates to an assembly for cooling a moving metal strip, the strip to be cooled being moved in a continuous manner, of the type comprising a main cooling roller, onto which the strip is pressed so as to form an arc whose inner face delimits, with the outer face of this roller, a contact zone which is suitable for discharging part of the heat of the strip towards the inner side of the main cooling roller, and at least one support roller on the outer face of the arc formed by the strip, which roller is suitable for holding the strip in contact with the main cooling roller, the or each support roller being arranged substantially parallel with the main cooling roller and so as to be movable in terms of rotation about the axis thereof, characterised in that the or each support roller is constituted, at least at the periphery, by a resiliently deformable and thermo-capacitive material, and in that the assembly comprises secondary cooling means which are suitable for forming, with a portion of the outer face of the or each support roller, a zone for transferring heat towards these secondary cooling means in order to discharge the heat transmitted from the strip to the or each support roller.

According to other features of this assembly, taken in isolation or according to all technically possible combinations:

the or each support roller is produced, at least at the periphery, from elastomer material, in particular from vulcanised silicone;

the material from which at least the periphery of the or each support roller is constituted has a thermal conductivity coefficient of less than 1 W/m.K;

the diameter of the or each support roller is between a quarter and a tenth of the diameter of the main cooling roller;

the secondary cooling means comprise at least one secondary cooling roller which is movable in terms of rotation about the axis thereof and which is arranged substantially parallel with the support rollers; and the assembly comprises means for being supplied with a heat-exchanging fluid, which means are common to the main cooling roller and to the secondary cooling means.

The invention will be better understood from a reading of the following description, given purely by way of example and with reference to the drawings, in which.

Figure 1:
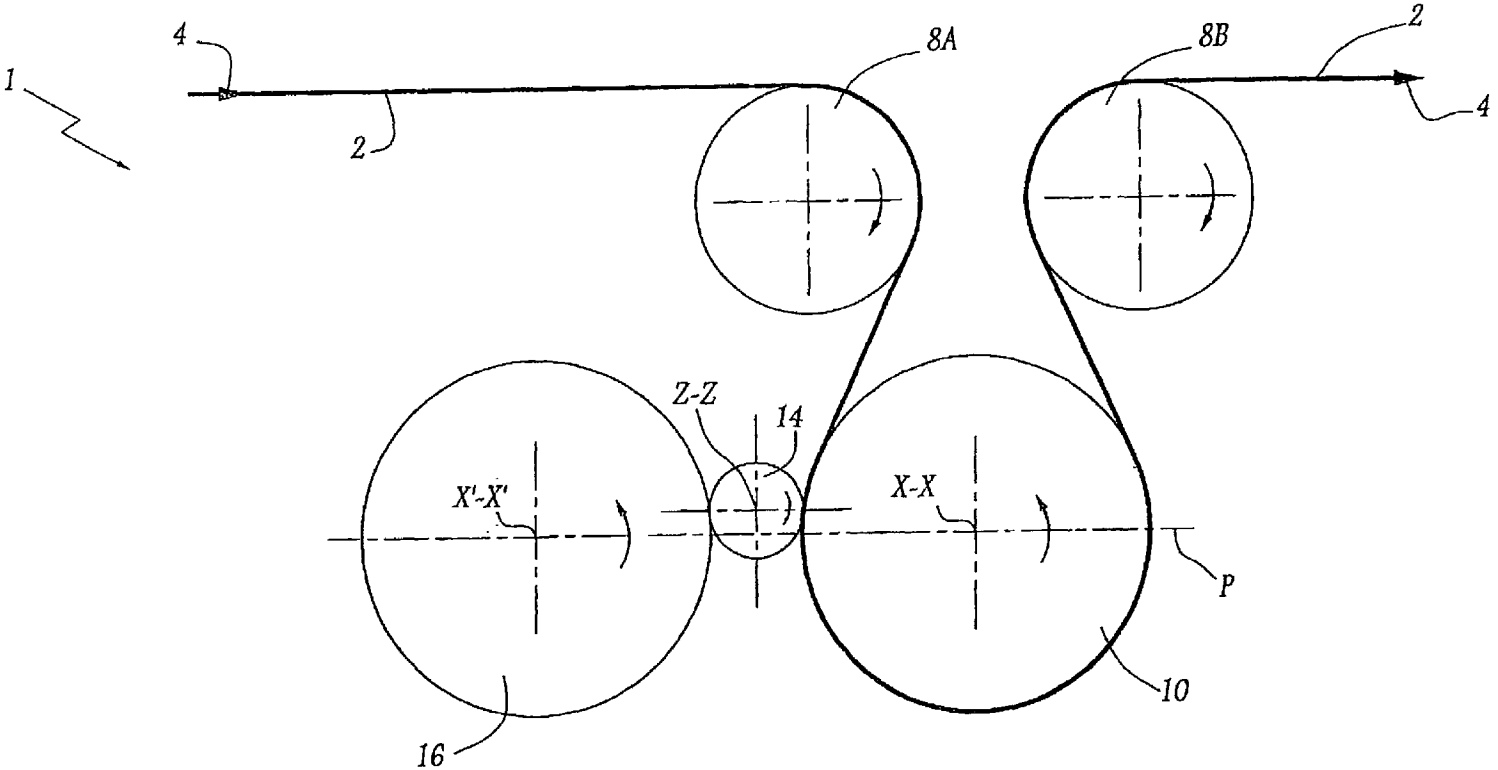
FIG. 1 is a schematic view of a cooling assembly according to the invention.

The assembly 1 illustrated in FIG. 1 is intended to cool a steel strip 2 moving in the direction indicated by the arrows 4. This assembly is used, for example, during treatments of coatings of the strip, in particular in a vacuum.

This assembly comprises:

two cylinders 8A and 8B for deflecting the strip 2, optionally provided with a motorised driving system which is not illustrated;

a main cooling roller 10, which has an axis X-X and which is arranged facing the deflection cylinders 8A and 8B so that the cylinders guide the strip 2 in an appropriate manner, at the inlet and at the outlet of the roller 10, respectively;

a roller 14 for supporting the strip on the cooling roller 10, having an axis Z-Z which is substantially parallel with the axis X-X of the roller 10, and preferably being arranged substantially perpendicularly relative to the zone in which the strip is rolled around the roller 10; and a secondary cooling roller 16,.having an axis X'-X' which is parallel with the axis Z-Z of the rollers 14, and being arranged in contact with these rollers 14 at the side opposite that of the roller 10, the same plane P forming centre planes for the rollers 10 and 16.

More precisely, the main cooling roller 10 and the secondary cooling roller 16 are capable of discharging thermal energy from their outer face towards the inner side of the rollers when a hot member is applied to them. To this end, the rollers 10 and 16 comprise, in known manner, a double casing which allows a cooling fluid, such as cold water, to be circulated at the inner periphery of these rollers. Other types of roller for cooling by means of contact, known to a person skilled in the art, may be envisaged.

The support roller 14 is itself formed from a unitary cylindrical component having an axis Z-Z or a stack of thin coaxial cylinders which may or may not be dependent. The roller 14 is produced from a resiliently deformable material, in particular from elastomer material. In the case of the present invention, the term "resiliently deformable material" is intended generally to refer to a material whose modulus of elasticity (or Young's modulus) is clearly lower than that of the material which forms the strip 2, for reasons which will be explained below. Examples of an appropriate elastomer material include vulcanised silicone.

The material which constitutes the support roller 14 further has preferred properties in terms of thermal conductivity and capacitance, that is to say, it must not be completely or almost completely resistant to conduction of heat, as a ceramic material might be, for example, but must also not necessarily provide a high level of conduction, in the manner of a conventional metal alloy. It must further be able to store, at the core thereof, the thermal energy drawn from the strip. The elastomer material from which the support roller 14 is constituted has, for example, a thermal conductivity coefficient of less than approximately 1 W/m.K (Watt per metre and per Kelvin) and a high calorific capacity, for example, in the order of 1000 J/kg.K (joule per kilogramme and per Kelvin).

The diameter of the roller 14 is preferably between a quarter and a tenth of the diameter of the roller 10. Furthermore, the length of this roller 14 is at least slightly greater than the width of the strip 2.

The operation of the assembly 1, which illustrates the method according to the invention, is as follows:

The strip 2, which originates upstream of the assembly 1 from an adjacent production assembly, a coil or a heating assembly (not illustrated), arrives at the inlet of the assembly 1 at a temperature which is considered to be hot, in particular between ambient temperature and a high temperature beyond which the material which constitutes the support roller 14 is at risk of being degraded, that is to say, for example, between ambient temperature and approximately 200° C. The movement thereof can be at least partially brought about by the cylinder 8A.

The strip 2, at the outlet of the cylinder 8A, is pressed onto the main cooling roller 10, around which the strip forms an arc which is as large as possible, for example, through approximately 240°, whose inner face is in contact with the outer face of the cylinder 10. When pressed onto the roller 10, the arc formed by the strip 2 is, preferably in the zone in which it begins to be wound, held in contact in a state pressed on this roller by the support rollers 14.

The relative position of the roller 14 in relation to the outer surface of the roller 10 is either pre-adjusted, in particular in accordance with the thickness of the strip 2, or controlled by resiliently deformable support means so that the outer face of the strip 2 is subjected to a contact pressure which is sufficient to flatten the strip along the width thereof and to promote the transfer of heat from the strip to the cooling roller 10 by increasing the contact surface-area between the inner face of this strip and the outer face of this roller.

The poor rigidity of the material which forms the support rollers limits the risks of the outer surface of the strip becoming marked, even when there is a fault in terms of parallelism between the axes Z-Z and X-X. Furthermore, the strip 2 has good transverse surface evenness.

Furthermore, since the material which forms the support rollers 14 is thermo-capacitive, part of the heat of the strip is transferred from the strip to the support roller, thus providing complementary cooling of the strip.

The movement of the strip 2 drives the support roller 14 in terms of rotation about the axis thereof, this roller 14 itself driving the secondary cooling roller 16. The contact zone that the support roller 14 maintains with the roller 16 allows heat to be transferred from the peripheral portion of the roller 14 to the inner side of the roller 16. Since the material which forms the support rollers is highly thermo-capacitive, the heat transferred from the strip to the support roller 14 is stored at the periphery of the roller 14 before itself being transferred to the cooling rollers 16.

The resilience of the material which forms the support roller 14 ensures, even when there is a lack of parallelism between the axes Z-Z and X'-X', the formation of a large contact surface-area between the roller 14 and the outer face of the roller 16, and therefore a high level of heat transfer.

At the outlet of the roller 10, the strip 2 rolls around the deflection cylinder 8B and leaves the assembly 1.

The method according to the invention thus allows the strip 2 to be cooled in a controlled manner, without damaging or marking the surfaces thereof. The cooling obtained is-both homogeneous, therefore ensuring the homogeneity of the properties of the cooled strip, and rapid, which allows the duration of the cooling and thus the length of the corresponding zone to be reduced.

The use of elastomer material to form the support rollers 14 is not very complex and the secondary cooling roller 16 is based on technology which is already in existence. Furthermore, the circulation network of the cooling fluid sent to the main cooling roller 10 can advantageously be used, for example, by means of branches, to supply the secondary cooling roller 16, That is to say, based on a pre-existing cooling assembly, the investment cost for providing an assembly according to the invention is minimal.

Figure 2:
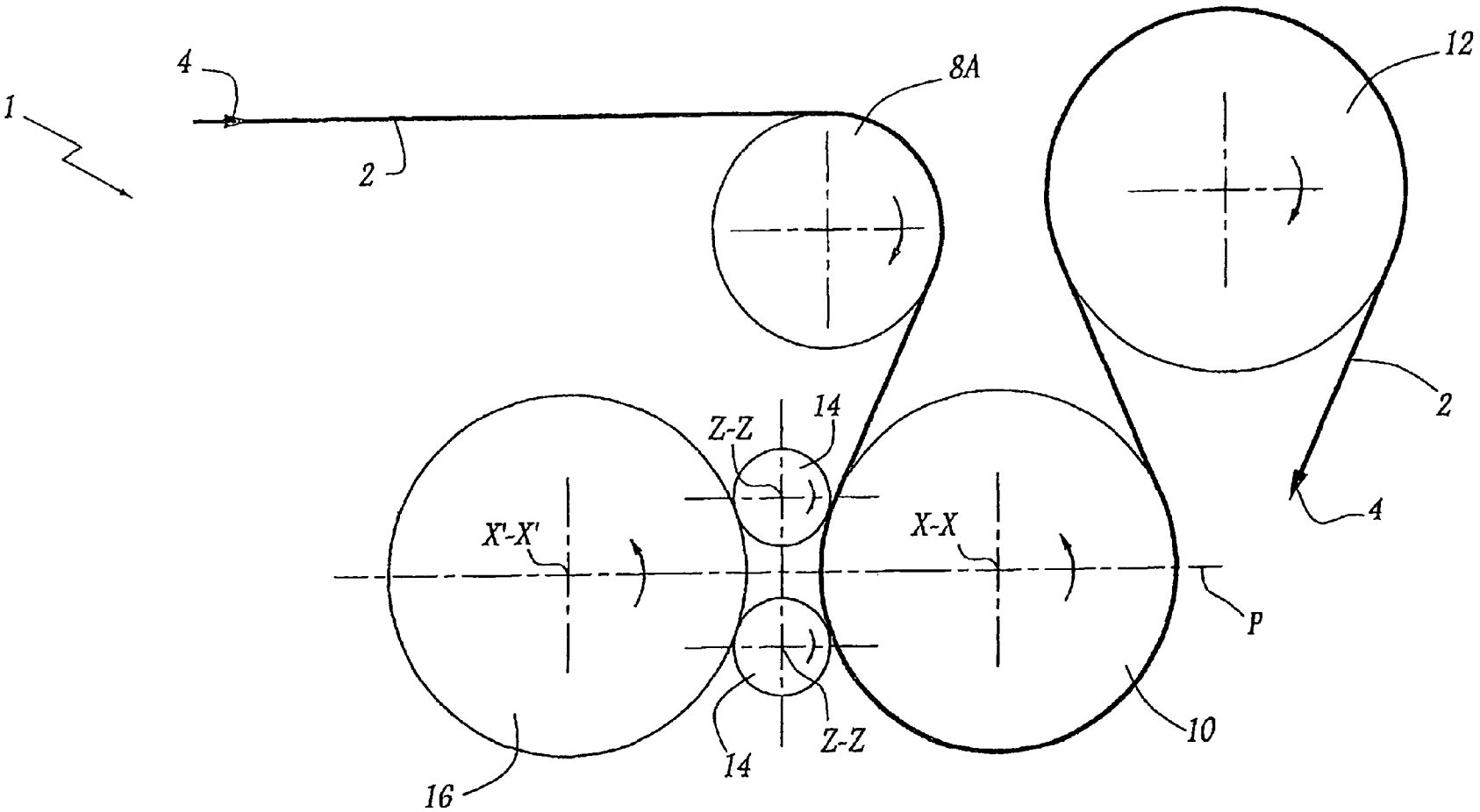
FIGS. 2 and 3 are views similar to FIG. 1, illustrating two variants of the assembly according to the invention.

FIG. 2 illustrates a variant of the assembly 1 which differs from that of FIG. 1, on the one hand, in that two support rollers 14 instead of one are positioned between the main cooling roller 10 and the secondary cooling roller 16 and, on the other hand, the outlet deflection cylinder 8B is replaced with a second main cooling cylinder 12 which is, for example, similar to the roller 10. The operation of this assembly is substantially similar to that of FIG. 1.

Application examples of methods according to the prior art and according to the invention using the assembly 1 of FIG. 2 are set out in detail below. In the two tables below, the operating parameters of this assembly are set out:

TABLE 1

| | Thermal conductivity coefficient (W/m · K) | Elasticity modulus (Young's modulus) (MPa) |
|---|---|---|
| Strip 2 | 60 | 205 000 |
| Cooling rollers 10, 12 and 16 | 20 | 205 000 |
| Support rollers 14 | 0.2 | 9.4 |

TABLE 2

| Radius of the cooling rollers 10, 12 and 16 | Radius of the support rollers 14 | Movement speed of the strip 2 | Flow rate of cooling water sent to the rollers 10, 12 and 16 | Length of the arc formed by the strip 2 around the roller 10 |
|---|---|---|---|---|
| 300 mm | 62.5 mm | 20 m/min | 10 l/min | 240° |

The table below summarises test results:

TABLE 3

| Test N° | Support of rollers 14 | Temperature of the strip 2 at the inlet of the roller 10(° C.) | Heat-exchange coefficient between the strip 2 and the roller 10 (W/m$^2$ · K) | Temperature of the strip 2 at the inlet of the roller 12 (° C.) | Heat exchange coefficient between the strip 2 and the roller 12 (W/m$^2$ · K) |
|---|---|---|---|---|---|
| 1 | NO | 75 | 10 | 70 | 8 |
| 2 | NO | 135 | 15 | 125 | 10 |
| 3 | YES | 75 | 150 | 45 | 100 |
| 4 | YES | 145 | 235 | 65 | 170 |

Tests 1 and 2 are carried out with no support roller, whilst tests 3 and 4 are carried out with the two support rollers 14 of elastomer material, as illustrated in FIG. 2.

A cooling efficiency which is fifteen times greater is found on the first main cooling roller 10 when it is associated with the two support rollers 14, but also a substantial increase on the second cooling roller 12. These results demonstrate the fact that the support rollers 14 provide the strip 2 with a high level of transverse surface evenness, allowing a high and homogeneous level of cooling over the width of the strip. Temperature measurements using infrared thermography further confirm that the temperature cooling is homogeneous.

Furthermore, with regard to the temperature reached by the support rollers 14, it has been possible to determine that the superficial layer of material of the rollers 14 can locally reach, for a relatively short period of time, in the order of the duration of the contact, the temperature of the strip 2 with which these rollers are in contact. This is in particular the case when the movement speed of the strip is low, for example, in the order of 20 m/min for the application example set out in detail in tables 1 and 2 above.

When the movement speed of the strip increases, however, the duration of contact of the elastomer material on the strip is not sufficient for the heat exchange to be complete, the temperature of the elastomer remaining lower than that of the strip. Thus, for a movement speed in the order of 150 m/min, which corresponds to a movement speed for an industrial assembly, and for an initial temperature of the strip in the order of 150° C., the elastomer material locally reaches at the most a temperature in the order of 100° C., which corresponds to a common operating temperature for most vulcanised elastomer materials.

Figure 3:
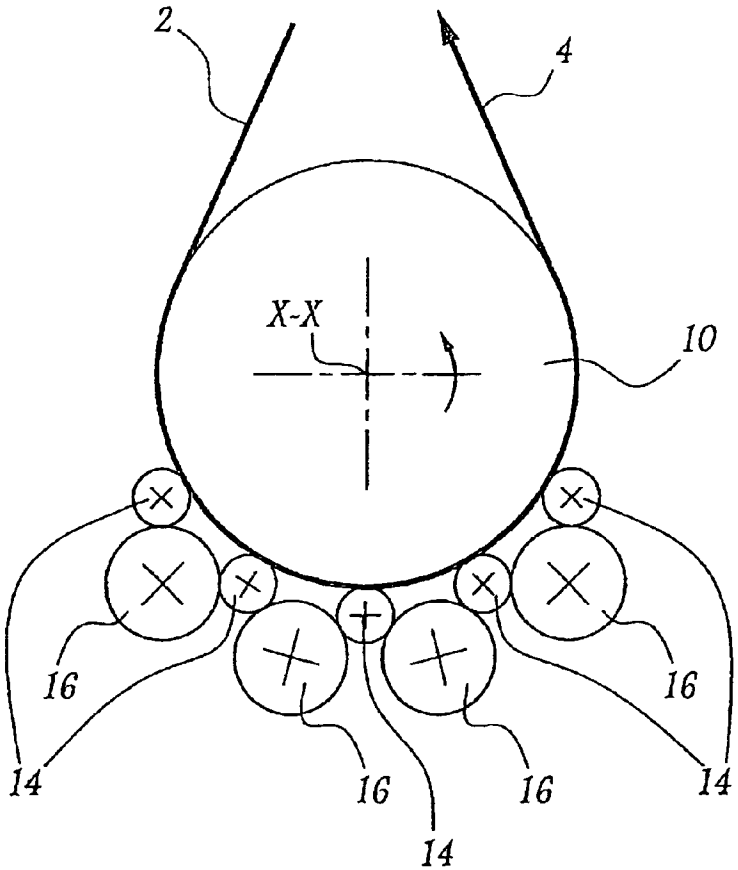

Various arrangements and variants of the method and the assembly described above can be envisaged. In particular, the number of support rollers and secondary cooling rollers, their dimensions and their arrangement are limited only by the free space which is available around the main cooling roller in question. Any combination is possible, as long as each support roller is cooled by at least one secondary roller. By way of example, FIG. 3 illustrates a main cooling roller 10 which is associated with five support rollers 14 and four secondary cooling rollers 16.

Furthermore, the support roller(s) 14 may comprise a multi-layer structure, only the outer layer(s) having to have the features in terms of flexibility and thermal capacitance set out above in order to carry out the invention.

Furthermore, the cooling roller 16 can be replaced by other secondary cooling means, such as systems for quenching by means of a gas jet as long as these means form an adequate heat discharge zone with a portion of the outer face of the support rollers.

The invention claimed is:

1. A method for cooling a moving metal strip, the method comprising:

moving the metal strip in a continuous manner;

providing the metal strip onto a main cooling roller which can be moved about the axis thereof such that the metal strip forms an arc around a portion of an outer face of the main cooling roller to form a contact zone which is suitable for discharging part of the heat of the metal strip towards an inner side of the main cooling roller, and pressing the strip against the main cooling roller by at least one support roller on an outer face of the arc formed by the metal strip, the support roller being arranged substantially parallel with the main cooling roller and so as to be movable in terms of rotation about the axis thereof, wherein the at least one support roller comprises, at least at a periphery thereof, a material which is resiliently deformable so that a module of elasticity of the material is lower than a modulus of elasticity of the metal strip, and which is thermo-capacitive so that the material is able to store, at a core thereof, a part of the thermal energy from the metal strip, wherein the heat transmitted from the metal strip to the at least one support roller is discharged by a secondary cooling unit which forms, with a portion of an outer face of the at least one support roller, a zone for transferring heat towards the secondary cooling unit from the supporting roller.

2. The method according to claim 1, wherein the at least one support roller extends at least over an entire width of the metal strip so as to apply to the outer face of the arc formed by the strip a pressure which is substantially homogeneous over the entire width.

3. The method according to claim 1, wherein the temperature of the metal strip pressed at an inlet of the main cooling roller is lower than a degradation temperature of the material which constitutes the at least one support roller.

4. A method for cooling a moving metal strip, the method comprising:

moving the metal strip in a continuous manner;

providing the metal strip onto a main cooling roller which can be moved about the axis thereof such that the metal strip forms an arc around a portion of an outer face of the main cooling roller to form a contact zone which is suitable for discharging part of the heat of the metal strip towards an inner side of the main cooling roller, and pressing the strip against the main cooling roller by at least one support roller on an outer face of the arc formed by the metal strip, the support roller being arranged substantially parallel with the main cooling roller and so as to be movable in terms of rotation about the axis thereof, wherein the at least one support roller comprises a material which is resiliently deformable and thermo-capacitive, and wherein the heat transmitted from the metal strip to the at least one support roller is discharged by a secondary cooling unit which forms, with a portion of an outer face of the at least one support roller, a zone for transferring heat towards the secondary cooling unit from the supporting roller, wherein the temperature of the metal strip pressed at an inlet of the main cooling roller is lower than a degradation temperature of the material which constitutes the at least one support roller, and wherein the temperature of the metal strip pressed at the inlet is lower than approximately 200° C.

5. An assembly for cooling a moving metal strip, the assembly comprising:

a main cooling roller onto which the metal strip is provided such that the metal forms an arc around a portion of an outer face of the main cooling roller to form a contact zone which is suitable for discharging heat from the strip towards an inner side of the main cooling roller;

at least one support roller contacting the outer face of the arc formed by the metal strip, the at least one support roller being arranged substantially parallel with the main cooling roller, wherein the at least one support roller comprises, at least at the periphery thereof, a material which is resiliently deformable so that a modulus of elasticity of the material is lower than a modulus of elasticity of the metal strip, and which is thermo-capacitive so that the material is able to store, at a core thereof, a part of the thermal energy from the metal strip; and a secondary cooling unit which forms, with a portion of the outer face of the at least one support roller, a zone for transferring heat towards the secondary cooling unit from the at least one support roller.

6. An assembly for cooling a moving metal strip, the assembly comprising:

a main cooling roller onto which the metal strip is provided such that the metal strip forms an arc around a portion of an outer face of the main cooling roller to form a contact zone which is suitable for discharging heat from the strip towards an inner side of the main cooling roller;

at least one support roller contacting the outer face of the arc formed by the metal strip, the at least one support roller being arranged substantially parallel with the main cooling roller, wherein the at least one support roller comprises a material which is resiliently deformable and thermo-capacitive; and a secondary cooling roller which forms, with a portion of the outer face of the at least one support roller, a zone for transferring heat towards the secondary cooling roller from the at least one support roller, wherein the at least one support roller is produced, at least at the periphery, from elastomer material, in particular from vulcanised silicone.

7. An assembly for cooling a moving metal strip, the assembly comprising:

a main cooling roller onto which the metal strip is provided such that the metal strip forms an arc around a portion of an outer face of the main cooling roller to form a contact zone which is suitable for discharging heat from the strip towards an inner side of the main cooling roller;

at least one support roller contacting the outer face of the arc formed by the metal strip, the at least one support roller being arranged substantially parallel with the main cooling roller, wherein the at least one support roller comprises a material which is resiliently deformable and thermo-capacitive; and a secondary cooling roller which forms, with a portion of the outer face of the at least one support roller, a zone for transferring heat towards the secondary cooling roller from the at least one support roller, wherein the material from which at least the periphery of the at least one support roller is constituted has a thermal conductivity coefficient of less than 1 W/m.K.

8. The assembly according to claim 5, wherein a diameter of the at least one support roller is between approximately a quarter and a tenth of a diameter of the main cooling roller.

9. The assembly according to claim 5, wherein the secondary cooling unit comprises at least one secondary cooling roller which is movable in terms of rotation about the axis thereof and which is arranged substantially parallel with the at least one support roller.

10. The assembly according to claim 5, wherein the assembly further comprises a system which supplies a heat-exchanging fluid to the main cooling roller and to the secondary cooling unit.

* * * * *